US007110944B2

(12) United States Patent
Balan et al.

(10) Patent No.: US 7,110,944 B2
(45) **Date of Patent: *Sep. 19, 2006**

(54) METHOD AND APPARATUS FOR NOISE FILTERING

(75) Inventors: Radu Victor Balan, Levittown, PA (US); Justinian Rosca, Princeton, NJ (US)

(73) Assignee: Siemens Corporate Research, Inc., Princeton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/191,105

(22) Filed: Jul. 27, 2005

(65) Prior Publication Data

US 2005/0261894 A1 Nov. 24, 2005

Related U.S. Application Data

(63) Continuation of application No. 10/007,460, filed on Dec. 5, 2001, now Pat. No. 6,952,482.

(51) Int. Cl.
*G10L 21/02* (2006.01)

(52) U.S. Cl. ..... 704/226; 704/200

(58) Field of Classification Search ..... 704/200, 704/226

See application file for complete search history.

(56) References Cited

U.S. PATENT DOCUMENTS

| | | | | |
|---|---|---|---|---|
| 6,122,610 | A * | 9/2000 | Isabelle | 704/226 |
| 6,359,923 | B1 * | 3/2002 | Agee et al. | 375/130 |
| 6,480,522 | B1 * | 11/2002 | Hoole et al. | 375/130 |
| 6,772,182 | B1 * | 8/2004 | McDonald et al. | 708/321 |

* cited by examiner

*Primary Examiner*—Daniel Abebe
(74) *Attorney, Agent, or Firm*—Donald B. Paschburg; F. Chau & Associates, LLC

(57) ABSTRACT

A method of filtering noise from a mixed sound signal to obtain a filtered target signal, includes inputting the mixed signal through a plurality of sensors into a plurality of channels, separately Fourier transforming each the mixed signal into the frequency domain, computing a signal short-time spectral amplitude $|\hat{S}|$ from the transformed signals, computing a signal short-time spectral complex exponential $e^{i\ arg(S)}$ from said transformed signals, where arg(S) is the phase of the target signal in the frequency domain, computing said target signal S in the frequency domain from said spectral amplitude and said complex exponential, and computing a spectral power matrix and using the spectral power matrix to compute the spectral amplitude and the spectral complex exponential.

9 Claims, 2 Drawing Sheets

METHOD AND APPARATUS FOR NOISE FILTERING

CROSS REFERENCE TO RELATED APPLICATION

This is a Continuation Application claiming priority to U.S. patent application Ser. No. 10/007,460, filed Dec. 5, 2001, now U.S. Pat. No. 6,952,482 which is hereby incorporated by reference.

FIELD OF THE INVENTION

This invention relates to filtering out target signals from background noise.

BACKGROUND OF THE INVENTION

There has always been a need to separate out target signals from background noise, whether the signals in question are sound or electromagnetic radiation. In the field of sound, noisy environments such as in modes of transport and offices present a communications problem, particularly when one is attempting to carry on a phone conversation. One known approach to this problem is a two-microphone system, wherein two microphones are placed at fixed locations within the room or vehicle and are connected to a signal processing device. The speaker is assumed to be static during the entire use of this device. The goal is to enhance the target signal by filtering out noise based on the two-channel recording with two microphones.

The literature contains several approaches to the noise filter problem. Most of the known results use a single microphone solution, such as is disclosed in S. V. Vaseghi, *Advanced Digital Signal Processing and Noise Reduction*, John Wiley & Sons, 2nd Edition, 2000. In particular, the single channel optimal solution (optimal with respect to the estimation variance) was disclosed in Y. Ephraim and D. Malah, *Speech enhancement using a minimum mean-square error short-time spectral amplitude estimator*, IEEE Trans. on Acoustics, Speech, and Signal Processing, 32(6): 1109–1121, 1984. A modified variant of that estimator was disclosed in Y. Ephraim and D. Malah, *Speech enhancement using a minimum mean-square error log-spectral amplitude estimator*, IEEE Trans. on Acoustics, Speech, and Signal Processing, 33(2):443–445, 1985, the disclosures of all three of which are incorporated by reference herein in their entirety.

SUMMARY OF THE INVENTION

According to an embodiment of the present disclosure, a method of filtering noise from a mixed sound signal to obtained a filtered target signal, includes inputting the mixed signal through a plurality of sensors into a plurality of channels, transforming, separately, via Fourier transformation each said mixed signal into the frequency domain, and determining a signal short-time spectral amplitude $|\hat{S}|$ from said transformed signals. The method further includes determining a signal short-time spectral complex exponential $e^{i\,arg(S)}$ from said transformed signals, where arg(S) is the phase of the target signal in the frequency domain, determining said target signal S in the frequency domain from said spectral amplitude and said complex exponential, and determining a spectral power matrix and using said spectral power matrix to determine said spectral amplitude and said spectral complex exponential.

The target signal S in the frequency domain is inverse Fourier transformed to produce a filtered target signal s in the time domain.

The spectral power matrix is determined by spectral channel subtraction.

According to an embodiment of the present disclosure, an apparatus for filtering noise from a mixed sound signal to obtained a filtered target signal includes a plurality of input channels for receiving mixed signals from a plurality of sensors, and a plurality of Fourier transformers, each receiving a mixed signal from one of said channels and Fourier transforming said mixed signal into a transformed signal in the frequency domain. The apparatus further includes a filter, said filter receiving said transformed signals and determining a signal short-time spectral amplitude $|\hat{S}|$ and a signal short-time spectral complex exponential $e^{i\,arg(S)}$ from said transformed signals, where arg(S) is the phase of the target signal in the frequency domain, wherein said filter determines said target signal S in the frequency domain from said spectral amplitude and said complex exponential, and a spectral power matrix updater, said updater receiving said transformed signals and determining therefrom a spectral power matrix, and outputting said spectral power matrix to said filter.

The apparatus further comprises an inverse Fourier transformer receiving said target signal S in the frequency domain and inverse Fourier transforming said target signal into a filtered target signal s in the time domain.

According to an embodiment of the present disclosure, a program storage device is provided readable by machine, tangibly embodying a program of instructions executable by machine to perform method steps for filtering noise from a mixed sound signal to obtaine a filtered target signal. The method includes inputting the mixed signal through a plurality of sensors into a plurality of channels, transforming, separately, via Fourier transformation each said mixed signal into the frequency domain, and determining a signal short-time spectral amplitude $|\hat{S}|$ from said transformed signals. The method further includes determining a signal short-time spectral complex exponential $e^{i\,arg(S)}$ from said transformed signals, where arg(S) is the phase of the target signal in the frequency domain, determining said target signal S in the frequency domain from said spectral amplitude and said complex exponential, and determining a spectral power matrix and using said spectral power matrix to determine said spectral amplitude and said spectral complex exponential.

The target signal S in the frequency domain is inverse Fourier transformed to produce a filtered target signal s in the time domain.

The spectral power matrix is determined by spectral channel subtraction.

The target signal is determined by multiplying said signal short-time spectral amplitude by said signal short-time spectral complex exponential.

DETAILED DESCRIPTION OF PREFERRED EMBODIMENTS

This invention generalizes the minimum variance estimators of Y. Ephraim and D. Malah, supra, to a two-channel scheme, by making use of a second microphone signal to further enhance the useful target signal at reduced level of artifacts.

Figure 1:
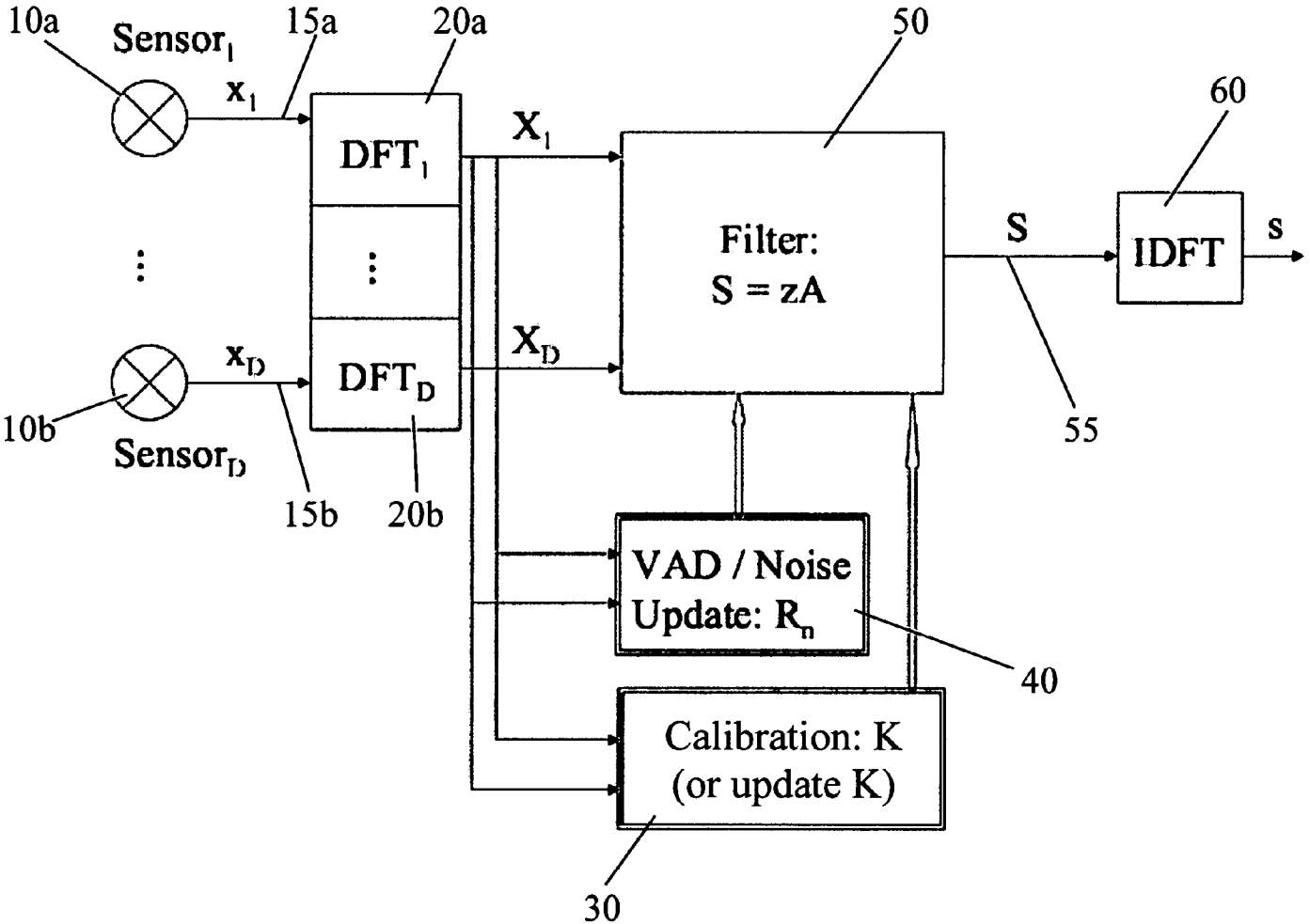
FIG. 1 is a block diagram of an embodiment of the invention.

Referring to FIG. 1, a plurality signals, $x_1, \ldots, x_D$ are input from a plurality of sensors 10 and each signal is received separately through a plurality of channels 15*a*, 15*b* into separate discrete Fourier transformers 20 to yield Fourier transformed signals $X_1, \ldots, X_D$. The sensors may be spaced at any suitable distance apart, and will typically be spaced within a fraction of an inch apart when the invention is used on small devices, such as cellphones, but may be spaced many feet apart for use in conference rooms or other large spaces. The invention may be used indoors or outdoors.

A mixing model may be given by:

$$x_1(t)=s(t)+n_1(t) \tag{1}$$

$$x_2(t)=k*s(t)+n_2(t) \tag{2}$$

$$\ldots$$

$$x_D(t)=k_D*s(t)+n_D(t) \tag{3}$$

where $x_1(t), x_2(t), \ldots, x_D(t)$ are the synchronously sampled signals, s(t) is the target signal as measured by the first sensor in the absence of the ambient noise, and $n_1(t), \ldots, n_D(t)$ are the ambient noise signals, all sampled at moment t. The sequences $k_2, \ldots, k_D$ represents the relative impulse response between the first channel and the corresponding channel and is defined in the frequency domain by the ratio of the two measured signals $(x_1, x_j)$ in the absence of noise. For example, for a pair of channels 1 and 2:

$$K(\omega)=\frac{X_2^0(\omega)}{X_1^0(\omega)} \tag{4}$$

A preferred method is applied in the frequency domain, thus we do not make explicit use of the sequences $k_j$, but rather of the functions $K_j(\,)$, 1<=j<=D. In frequency domain, the mixing model of Equations 1, 2, 3 becomes:

$$X_1(\omega)=S(\omega)+N_1(\omega) \tag{5}$$

$$X_2(\omega)=K(\omega)S(\omega)+N_2(\omega) \tag{6}$$

$$\ldots$$

$$X_D(\omega)=K_D(\omega)S(\omega)+N_D(\omega) \tag{7}$$

where $X_1, \ldots, X_D$, S, $N_1, \ldots, N_D$ are the short-time spectral representations of $x_1, \ldots, x_D$, s, $n_1$, and $n_D$, respectively.

It will generally be preferable to calibrate the system beforehand to obtain a precise value of for K( ), which will vary according to the environment and equipment. This can be done by receiving the target sound (e.g., a voice speaking a sentence) through the plurality of sensors in the absence or near absence of noise. Based on these recordings, $x_1^c(t), \ldots, x_D^c(t)$, the constants $K_j(\omega)$ are estimated by:

$$K(\omega)=\frac{\sum_{t=1}^{F} X_2^c(l,\omega)\overline{X_1^c(l\cdot\omega)}}{\sum_{t=1}^{F} |X_1^c(l,\omega)|^2} \tag{8}$$

where $X_1^c(l,\omega), X_j^c(l,\omega)$ represents the discrete windowed Fourier transform at frequency ω, and time-frame index l of the signals $x_1^c$, $x_j^c$. The time-frame index l represents the current block of signal data and will be omitted from the remaining equations in this disclosure for reasons of clarity. Calibration may be effected by a separate Calibrator 30, which performs the estimation of Equation 6. Windowing may be effected by use of a Hamming window w(.) of a suitable size, such as 512 samples, such as are described in D. F. Elliott (Ed.), *Handbook of Digital Signal Processing*, Engineering Applications, Academic Press, 1987, the disclosures of which are incorporated by reference herein in their entirety. An alternative to calibrating K is to update its value on-line. K would be adapted either on every time frame, or on frames where voice has been detected using a linear combination between its old value and the value given by Equation 8:

$$K^t(\omega)=(1-\alpha)K^{t-1}(\omega)+\alpha K(\omega) \tag{8b}$$

where the typical value of the adaptation rate α is 0.2. In this case the Calibrator 30 is instead an Updater 30.

After calibration, it is desirable to enhance the target signal. During nominal use, the invention will use $X_1(\omega), \ldots, X_D(\omega)$ (i.e., the discrete Fourier transforms on current time-frame of $x_1, \ldots, x_D$, windowed by ω and an estimate of a noise spectral power D×D matrix $R_n$:

$$R_n=[R_{11}, \ldots, R_{1D}; \ldots; R_{D1}, \ldots, R_{DD}] \tag{9}$$

The ideal noise spectral matrix is defined by $$\hat{R}_n = E\begin{bmatrix} N_1 \\ \vdots \\ N_2 \end{bmatrix}[\overline{N}_1 \;\ldots\; \overline{N}_2] \tag{10}$$

where E is the expectation operator. During normal operation, the method of the invention will update the noise spectral power matrix $R_n^{new}$ periodically, as will be described more fully below. On startup, the system will preferably use spectral subtraction on one of the channels, such as for example the first channel 15*a*, to estimate the signal spectral power:

$$R_s=\theta(|X_1|^2-R_{nll}),\ \theta(x)=\begin{cases} x, & \text{if } x>C_vR_{nll} \\ C_vR_{nll}, & \text{otherwise} \end{cases} \tag{11}$$

where $C_v$ is a floor-level noise parameter in the range of 0 to 1. Typically, $C_v$ may be set to about 0.05 for most purposes. The setting and updating of the spectral power matrix is performed by the spectral power matrix updater 40.

Next the invention computes a short-time spectral amplitude estimate. More specifically we are looking for the minimum variance estimator of short time spectral amplitude |S|. Using the previous assumptions, the MVE of the short-time spectral amplitude |S| is given by:

$$|S|=E[|S||X_1, \ldots, X_D] \tag{12}$$

such as is described in H. V. Poor, *An Introduction to Signal Detection and Estimation*, 2nd Edition, Springer Verlag, 1994, the disclosures of which are incorporated by reference herein in their entirety.

The short-time spectral amplitude may be determined by:

$$|\hat{S}| = \frac{\sqrt{\pi}}{2}\sqrt{\frac{R_s}{1+R_sK^*R_n^{-1}K}}\exp\left(-\frac{|Y|}{2}\right)\left[(1+|Y|)I_0\left(\frac{|Y|}{2}\right)+|Y|I_1\left(\frac{|Y|}{2}\right)\right] \quad (13)$$

where:

$$Y = \frac{K^*R_n^{-1}X}{K^*R_n^{-1}K} \quad (14)$$

and $I_0(.)$ and $I_1(.)$ are the modified Bessel functions of the first kind and order 0, respectively 1 (such as are described in I. S. Gradshteyn and I. M. Ryzhik, *Table of Integrals, Series, and Products,* $4^{th}$ Edition, Academic Press, 1980). The short-time spectral complex exponential may be determined by:

$$z = \frac{Y}{|Y|} \quad (15)$$

Generally speaking, the estimations of short-time spectral amplitude and short-time spectral complex exponential (13), (15), will be optimal in the sense of minimum variance estimation and minimum mean square error, if the following conditions are satisfied:

(a) The mixing model (1,2,3) is time-invariant;

(b) The target signal s is short-time stationary and has zero-mean Gaussian distribution;

(c) The noise n is short-time stationary and has zero-mean Gaussian distribution;

(d) The target signal s is statistically independent of the noises $n_1; \ldots; n_D$.

We may now compute the target signal short-time estimate by multiplying (13) with (15):

$$S = z|\hat{S}| \quad (16)$$

and return in time domain through the overlap-add procedure using the windowed inverse discrete Fourier transformer 50 through the output channel 55, thereby obtaining an estimate for the target signal s in the time domain, which is the noise-filtered target signal s. Generally the three steps of estimating the signal short-time spectral amplitude, estimating the signal short-time spectral complex exponential, and computing S is handled by the filter 50.

Lastly, the power matrix is updated. This may be done on a regular periodic basis, or whenever there is a lull in the target signal, such as a lull in speech. For example, a voice activity detector (VAD), such as for example that described in R. Balan, S. Rickard, and J. Rosca, *Method for voice detection in car environments for two-microphone inputs*, Invention Disclosure, December 2000, IPD 2000E22789 US, the disclosures of which are incorporated by reference herein in their entirety, may be used to detect whether voice is present in the current frame of data. If voice is not present, the power matrix updater 40 then updates the noise spectral power matrix using the formula:

$$R_n^{new} = (1-\alpha)R_n + \alpha\begin{bmatrix} X_1 \\ \vdots \\ X_D \end{bmatrix}[\overline{X_1}\ldots\overline{X_D}] \quad (17)$$

where α is a noise learning rate between 0 and 1, and will typically be set to about 0.2 for most applications.

Figure 2:
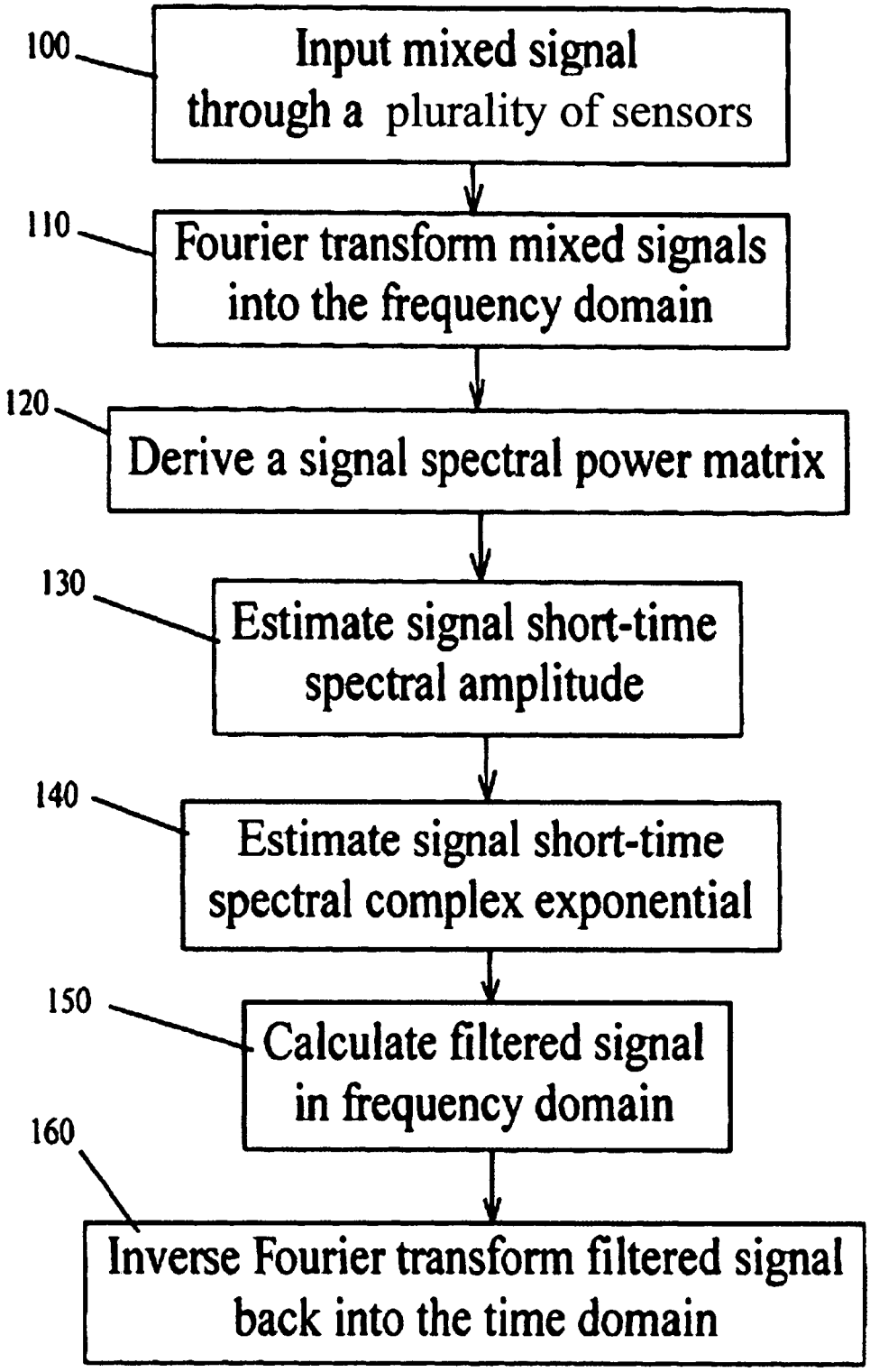
FIG. 2 is a flow diagram of a method of the invention.

Referring to FIG. 2, the steps of the method of the invention may be summarized as follows:

1. Input a mixed signal through a plurality of sensors.
2. Fourier transform each mixed signal into the frequency domain.
3. Derive 100, a signal spectral power matrix.
4. Estimate 110, the signal short-time spectral amplitude.
5. Estimate 120, the signal short-time spectral complex exponential.
6. Estimate 130, the filtered target signal in the frequency domain.
7. Return 140, the filtered target signal to the time domain by inverse Fourier transformation.

The methods of the invention may be implemented as a program of instructions, readable and executable by machine such as a computer, and tangibly embodied and stored upon a machine-readable medium such as a computer memory device.

It is to be understood that all physical quantities disclosed herein, unless explicitly indicated otherwise, are not to be construed as exactly equal to the quantity disclosed, but rather as about equal to the quantity disclosed. Further, the mere absence of a qualifier such as "about" or the like, is not to be construed as an explicit indication that any such disclosed physical quantity is an exact quantity, irrespective of whether such qualifiers are used with respect to any other physical quantities disclosed herein.

While preferred embodiments have been shown and described, various modifications and substitutions may be made thereto without departing from the spirit and scope of the invention. Accordingly, it is to be understood that the present invention has been described by way of illustration only, and such illustrations and embodiments as have been disclosed herein are not to be construed as limiting to the claims.

What is claimed is:

1. A computer-implemented method of filtering noise from a mixed sound signal to obtained a filtered target signal comprising:

inputting the mixed signal through a plurality of sensors into a plurality of channels;

transforming, separately, via Fourier transformation each said mixed signal into the frequency domain;

determining a signal short-time spectral amplitude $|\hat{S}|$ from said transformed signals;

determining a signal short-time spectral complex exponential $e^{i\ arg(S)}$ from said transformed signals, where arg(S) is the phase of the target signal in the frequency domain;

determining said target signal S in the frequency domain from said spectral amplitude and said complex exponential; and determining a spectral power matrix and using said spectral power matrix to determine said spectral amplitude and said spectral complex exponential.

2. The method of claim 1, wherein said target signal S in the frequency domain is inverse Fourier transformed to produce a filtered target signal s in the time domain.

3. The method of claim 1, wherein said spectral power matrix is determined by spectral channel subtraction.

4. An apparatus for filtering noise from a mixed sound signal to obtained a filtered target signal, comprising:

a plurality of input channels for receiving mixed signals from a plurality of sensors;

a plurality of Fourier transformers, each receiving a mixed signal from one of said channels and Fourier transforming said mixed signal into a transformed signal in the frequency domain;

a filter, said filter receiving said transformed signals and determining a signal short-time spectral amplitude $|\hat{S}|$ and a signal short-time spectral complex exponential $e^{i\,arg(S)}$ from said transformed signals, where arg(S) is the phase of the target signal in the frequency domain;

wherein said filter determines said target signal S in the frequency domain from said spectral amplitude and said complex exponential; and a spectral power matrix updater, said updater receiving said transformed signals and determining therefrom a spectral power matrix, and outputting said spectral power matrix to said filter.

5. The apparatus of claim 4, further comprising an inverse Fourier transformer receiving said target signal S in the frequency domain and inverse Fourier transforming said target signal into a filtered target signal s in the time domain.

6. A program storage device readable by machine, tangibly embodying a program of instructions executable by machine to perform method steps for filtering noise from a mixed sound signal to obtained a filtered target signal, said method steps comprising:

inputting the mixed signal through a plurality of sensors into a plurality of channels;

transforming, separately, via Fourier transformation each said mixed signal into the frequency domain;

determining a signal short-time spectral amplitude $|\hat{S}|$ from said transformed signals;

determining a signal short-time spectral complex exponential $e^{i\,arg(S)}$ from said transformed signals, where arg(S) is the phase of the target signal in the frequency domain;

determining said target signal S in the frequency domain from said spectral amplitude and said complex exponential; and determining a spectral power matrix and using said spectral power matrix to determine said spectral amplitude and said spectral complex exponential.

7. The device of claim 6, wherein said target signal S in the frequency domain is inverse Fourier transformed to produce a filtered target signal s in the time domain.

8. The device of claim 6, wherein said spectral power matrix is determined by spectral channel subtraction.

9. The device of claim 6, wherein said target signal is determined by multiplying said signal short-time spectral amplitude by said signal short-time spectral complex exponential.

* * * * *